United States Patent [19]

Chapman

[11] 3,937,767

[45] Feb. 10, 1976

[54] CARBURETOR

[76] Inventor: Donald L. Chapman, 191 Osceola Ave., Tallmadge, Ohio 44278

[22] Filed: Oct. 1, 1974

[21] Appl. No.: 510,936

Related U.S. Application Data

[63] Continuation-in-part of Ser. No. 298,187, Oct. 16, 1972, Pat. No. 3,855,366.

[52] U.S. Cl. ..... 261/41 B; 261/50 A; 261/DIG. 18

[51] Int. Cl.[2] ..... F02M 11/08

[58] Field of Search ..... 261/DIG. 18, 50 R, 50 A, 261/41 B

[56] References Cited

UNITED STATES PATENTS

| | | | |
|---|---|---|---|
| 2,595,721 | 5/1952 | Snyder | 261/50 A |
| 2,710,604 | 6/1955 | Snyder | 261/50 A |
| 3,026,095 | 3/1962 | Trammell et al. | 261/50 R |
| 3,086,758 | 4/1963 | Greene | 261/44 R |
| 3,322,408 | 5/1967 | Stoltman | 261/50 A |
| 3,336,014 | 8/1967 | Shorrock | 261/50 R |
| 3,350,073 | 10/1967 | Hill | 261/44 R |
| 3,493,217 | 2/1970 | Farley | 261/44 R |
| 3,709,469 | 1/1973 | Edmonston et al. | 261/44 R |
| 3,752,454 | 8/1973 | Korponay | 261/44 R |
| 3,822,058 | 7/1974 | Carter | 261/44 R |

*Primary Examiner*—Tim R. Miles

[57] ABSTRACT

Carburetor for gasoline engine has connecting air-intake and gas mixture chambers separated by an adjustable, air-metering valve provided with throttle opening means of variable flow area and communicating with said connecting chambers for providing venturi effect. Gas metering member in gas mixture chamber adjustable with movement of valve to vary amount of gas globules metered out to mix with air throttled through the opening means in valve, according to demand of engine. Efficiency of carburetion improved by controlled suction of air at any given throttle opening, for combination with likewise controlled flow of gas globules, in a proportion with reference to said venturi effect which provides maximum power and performance efficiency at any given engine speed, while accomplishing substantially complete atomization of the gas globules at all engine speeds.

4 Claims, 6 Drawing Figures

10
11
12
13
14
15
16
17
18
19
22
22a
22b
23
23a
24
25
27
28
29
31
32
33
34

CARBURETOR

This is a continuation in-part of application Ser. No. 298,187, filed Oct. 16, 1972, now U.S. Pat. No. 3,855,366.

BACKGROUND OF THE INVENTION

Heretofore, carburetors, as for gasoline engines, have been of a general type including a device for sending air through or over a liquid fuel, so as to produce an explosive mixture. In other words, the process of carburetion includes charging air with hydrocarbon, such as gasoline in finely divided liquid form, whereby the resulting gas globules can be burned for production of energy. In spite of the vast number of improvements heretofore made in conventional carburetors even the best of them have been inefficient in atomizing the gas globules, and in fact they only slobbered the gas out, especially at partial throttle. Such carburetors, have to a large extent, been unsatisfactory because when they were large enough for a given purpose they were too large for maximum efficiency at partial throttle, and when they were on the small side they were not sufficiently sensitive to accomplish good atomization of the gas but were too restrictive for accomplishing peak power performance.

SUMMARY OF THE INVENTION

The present invention relates to an improved carburetor, as for a gasoline engine, by which maximum operating efficiency is accomplished by accurately controlling the effective atomization of the gas globules with reference to selectively variable sizes of a venturi opening in the carburetor. For the purpose of efficiently controlling the mixture of the air and gas globules, in proportion to the degree of power required by an operator of the engine, a speed controlling accelerator is operable to shift a valving member across a passage between connecting air-intake and gas mixture chambers, selectively to vary the effective flow area of a throttle opening in the valving member, so that as the demand for power is increased, the flow area of the throttle opening is proportionately increased. With such opening movement of the valving member a gas supply tube, carried by the valving member and connected to a source of the gas, is likewise proportionately moved with reference to a metering device located within the gas mixing chamber, to meter out the gas in requisite proportion to the changes in flow area of the throttle opening. Thus, by varying the flow area of the venturi opening, the air pressure is varied proportionately and the speed of the air, and consequently that of the gas, is also varied. To this end, the gas metering device may include relatively movable parts which are operable by movement of the valving member to control the amount of atomized gas metered into the mixing chamber, in predetermined precise relationship to the controlled flow of air through the venturi opening to the mixing chamber. This gas metering device is particularly adaptable for mixing the gas globules and air, self-adjustably according to the requirements at various speeds of engine operation, to accomplish complete ignition and utilization of the gas globules at all such speeds.

Objects of the invention, other than as described above, will be manifest from the following brief description and the accompanying drawings.

DESCRIPTION OF INVENTION

Figure 1:
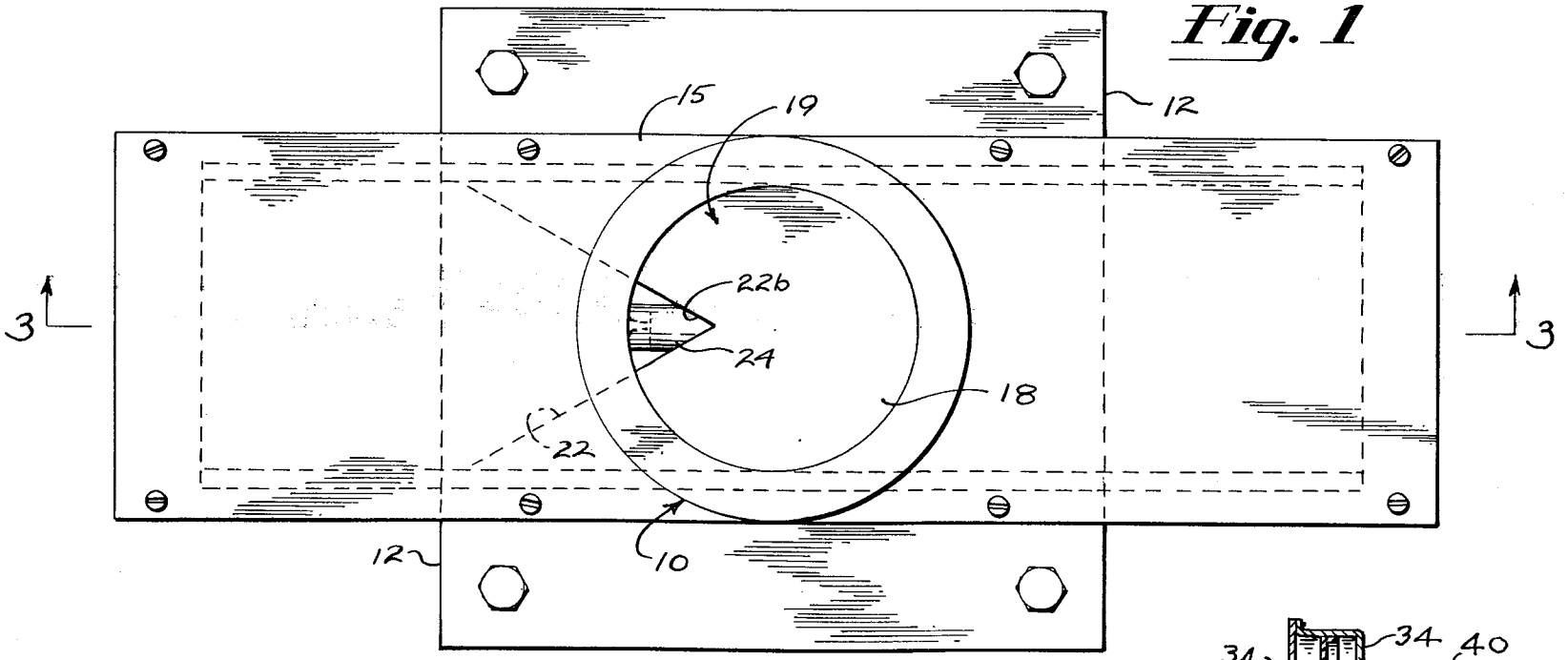
FIG. 1 is a top plan view of a carburetor embodying the features of the invention.
Figure 2:
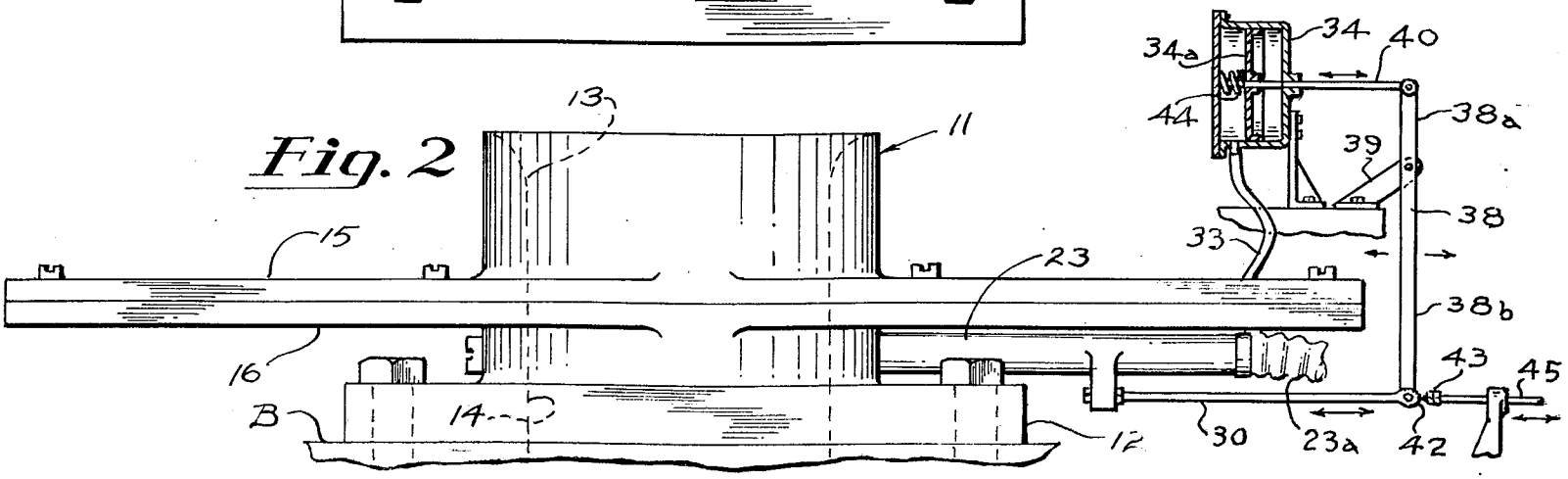
FIG. 2 is a front elevation of the carburetor shown in FIG. 1 on the same scale, and mounted on a gasoline engine block (partly broken away).
Figure 3:
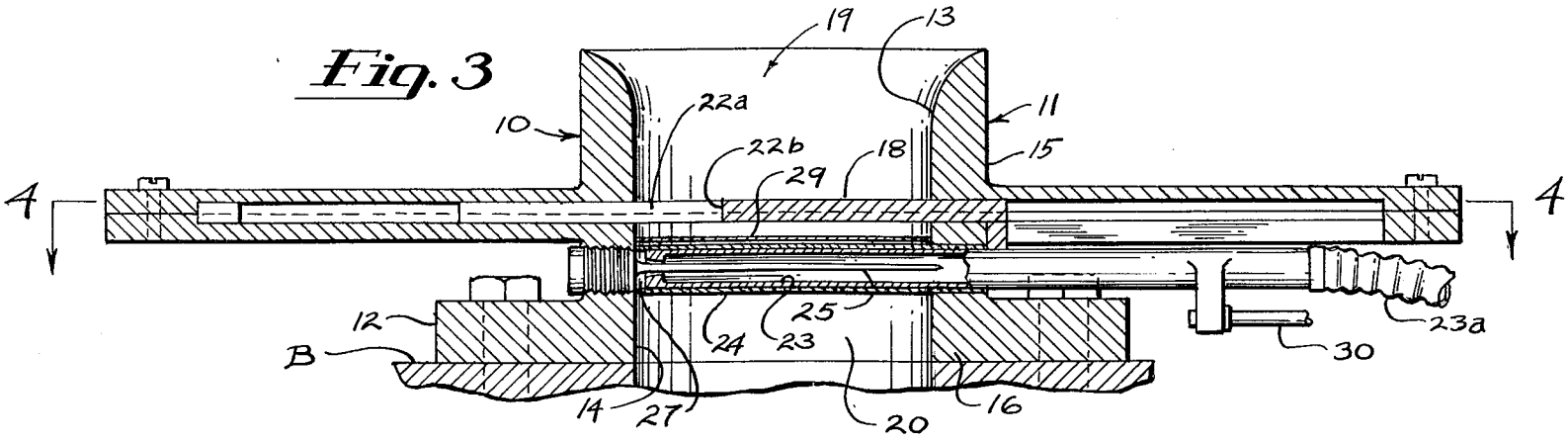
FIG. 3 is a vertical cross-section, taken on the line 3—3 of FIG. 1 and on the same scale.
Figure 4:
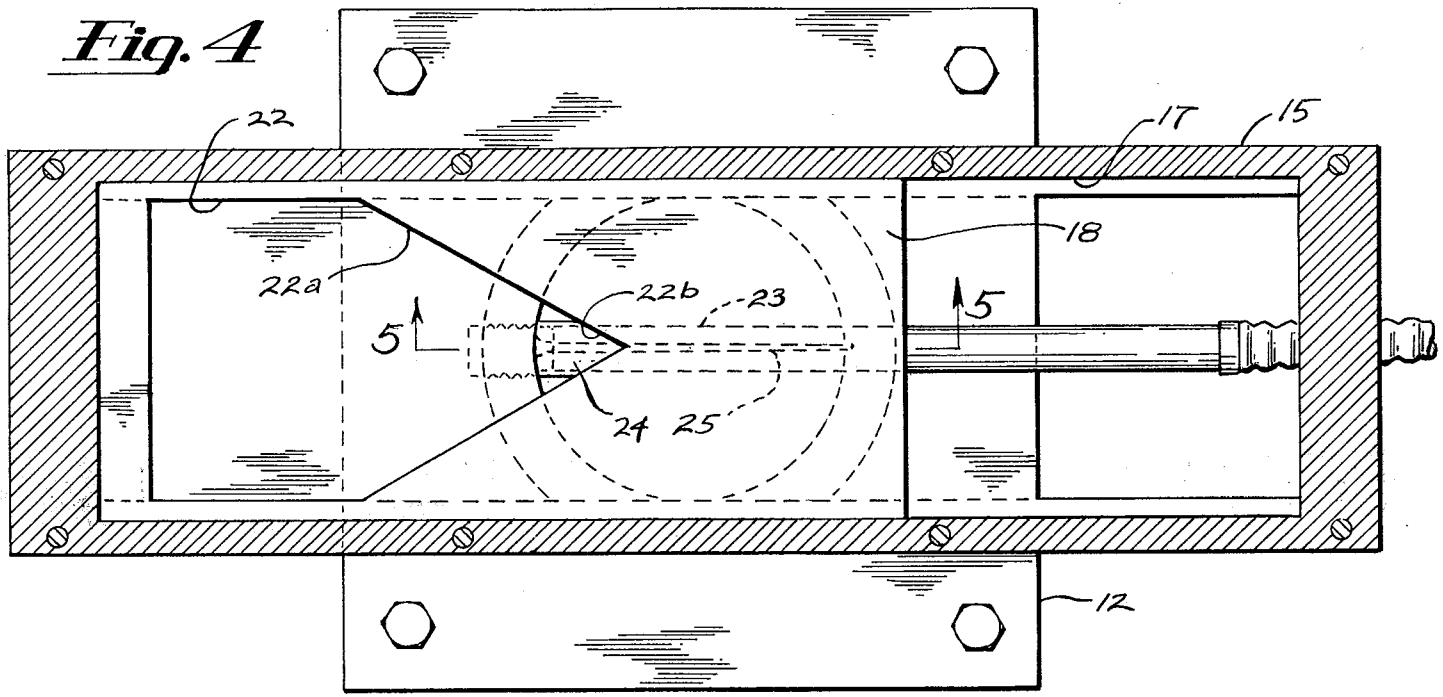
FIG. 4 is a horizontal cross-section, taken on the line 4—4 of FIG. 3 and on the same scale.
Figures 5, 6:
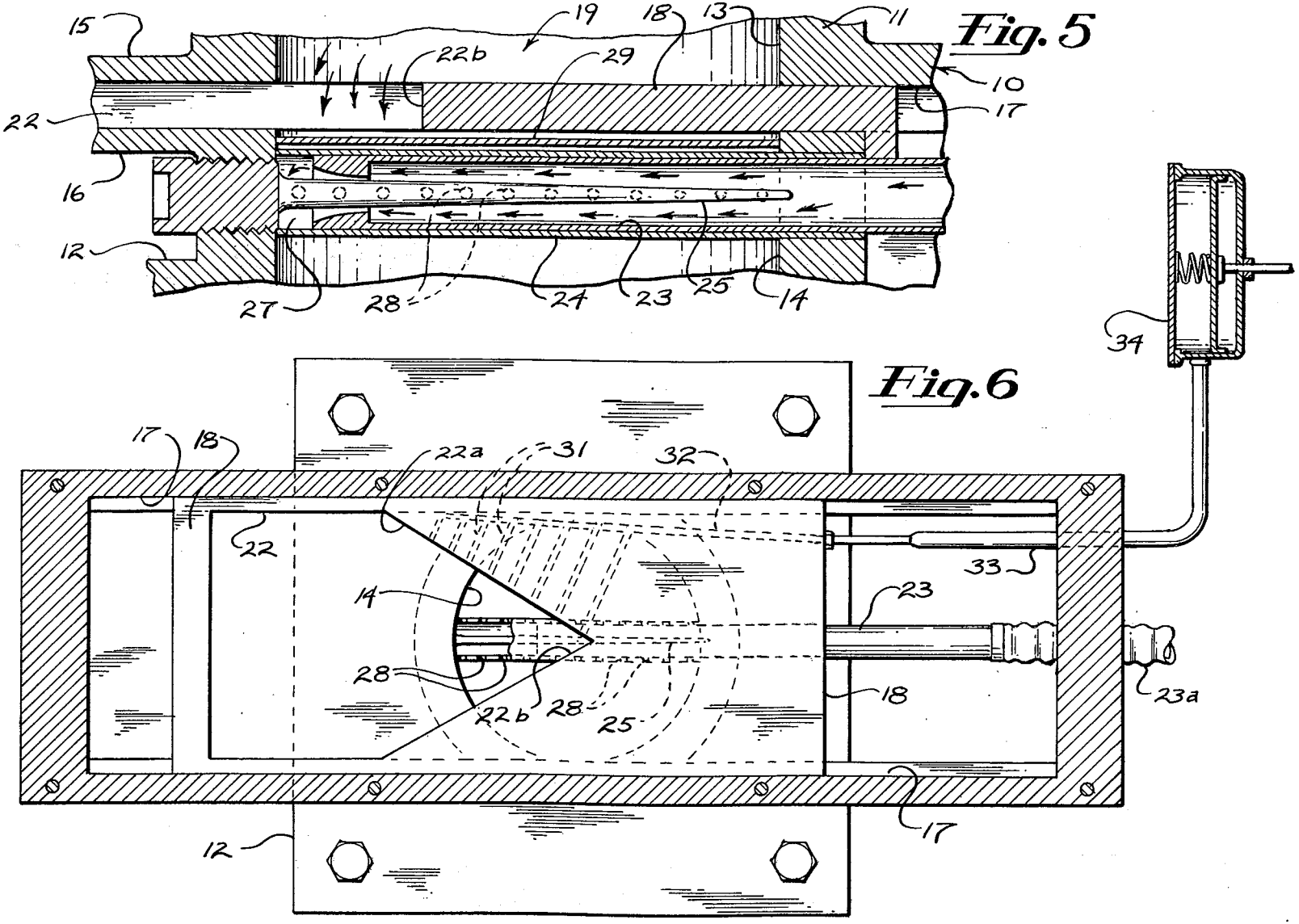
FIG. 5 is an enlarged cross-section taken substantially on the line 5—5 of FIG. 4.
FIG. 6 is a view corresponding to FIG. 4, illustrating a modified form of the invention.

Referring to FIGS. 1 to 5 of the drawings generally, and to FIGS. 3 to 5 particularly, the numeral 10 designates a carburetor, embodying the features of the invention, mounted on an engine block B (see FIG. 2) and including a tubular housing 11 having integral flange means 12 for securing the same on block B, thereby to align a passage 13 through the housing with a passage 14 in the blck B for connecting with a combustion chamber (not shown) of the engine.

The carburetor 10 may comprise top and bottom sections 15 and 16, including complementally connected, lateral extensions 15 and 16 thereof in a plane at right angles to the central axis of the tubular housing 11, and defining laterally spaced guide slots 17, 17 for slidable reception of spaced side edges of a slide-valve plate 18, said plate serving to divide the passage 14 into an outer air-intake chamber 19 and an inner gas-mixing chamber 20. The plate 18 is provided with a throttle aperture means 22 therethrough, adapted to have a variable effective flow area, presented within the mixing chamber 20, the flow area being varied by sliding adjustment of the slide plate. As best shown in FIG. 4, the over-all size of the throttle aperture means 22 may be relatively large, with converging sides **22*a* thereof cooperating with the passage 14 of chamber 20 thereby defining a relatively small, generally triangular, air-throttling opening communicating with the axially aligned chambers 19 and 20, which triangular opening can be selectively enlarged in effective flow area by said movement of plate 18 to the right in the condition shown in FIGS. 1 to 5**.

Affixed to the slide plate 18, exteriorly of the tubular housing 11, to be movable with said plate, may be a fluid-gas supply tube 23 which extends through the wall **16*a* of the bottom section 16, below plate 18, and is slidably received through a perforated, gas-metering tube 24, suitably affixed between diametrically opposite wall portions of the passage 13, to be in otherwise fluid sealed relation thereto. Fluid gas may be supplied to the tube 23 from a source thereof (not shown), through flexible tubing 23*a*, and the gas flow from the supply tube 23 into mixing chamber 20 is adapted to be automatically adjusted or varied by any sliding movement of the slide plate 18**.

To this end, a free end of the gas-metering tube 24 within the tube 23, may be provided with a suitable opening **24*a* for centered reception therethrough of a tapered metering needle 25, which is selectively adjustable affixed to the passage wall 13. The arrangement is such that in all positions of axial sliding movement of the gas supply tube 23 with reference to the tapered needle 25, gas supplied through said tube 23 exits into the adjusted, enclosed space 27 at the corresponding end of the metering tube, to be sucked through one or more uncovered apertures 28, 28 of one or more series thereof extending longitudinally along the wall of the metering tube 24, (See FIG. 5**)

Accordingly, in all axially adjusted positions of the gas supply tube 23 and with all effective diameters of the tapered needle presented through the hole 24*a* in the exit end of the supply tube, the fixed metering tube 24 accurately controls the amount of gas being metered out directly in proportion to the amount and speed of the air rushing through the effective venturi opening 22*b*, the variable flow area of which opening is controlled by the speed, or power required to be obtained from the engine. A V-shaped hood or shield 29 may be affixed in the throttle passage 14 to overlie the length of the gas-metering tube 24, for deflecting the air rushing through venturi opening 22*b*, uniformly to pass around said metering tube.

In use of the improved carburetor shown in FIGS. 1 to 5, in conjunction with a gasoline engine, having a known type of manually operable accelerator means for controlling the speed of the engine, the accelerator (not shown) is operable through the rod 30 to enlarge the effective flow area or the size of the venturi opening 22*b*, by sliding movement of the plate 18 in the guide slots 17 to the right from the position of the plate as shown in FIGS. 1 and 2. This movement, in addition to enlarging the effective flow-area of the venturi opening 22*b*, also enlarges the flow-area of the gas-metering opening 24*a* in the adjusted gas supply tube 23, as well as exposing one or more additional holes 28 in the gas metering tube 24 for passage of additional gas from the supply tube into the path of the larger amount of air being sucked through the enlarged venturi opening 22*b* as described above.

In use or operation of the improved carburetor, described above in particular reference to FIGS. 1 to 5, with a gas-operated, internal-combustion engine, air is in known manner sucked into the air-intake chamber 19, through the adjustably effective venturi opening 22*b* of slide-valve plate 18, and into the mixing chamber 20, to be thoroughly mixed with combustible gas globules or particles exuded or sucked from the aperture 28 at the discharge end 24 of tube 23 carried by the slidable plate 18. In other words, liquid gasoline is drawn into the air-intake chamber to be intimately mixed with the air rushing through the selectively adjusted venturi opening 22*b* as a relatively fine spray, generally in a ratio of about one part of gasoline by weight to fifteen parts of air, for example. The amounts and proportions of gasoline and air mixture which passes through the carburetor is, for the most part, variably controlled by an accelerator (not shown) which in turn adjusts the sliding movement of valve plate 18 carrying the gas tube 23 with it.

As the mixture leaves the carburetor 10, it is drawn into engine cylinder or cylinders, (not shown), where it will be exploded by ignition means in known manner. It is known, however, that even the best available carburetors have not been capable of accomplishing complete atomization of the gas globules. In other words, the gas globules were not completely consumed upon ignition of the same in the engine cylinders at some, if not all, acceleration speeds of operation of the engine. Complete atomization is accomplished by the improved carburetor, at all acceleration speeds, by selectively proportioning of the amount of gas metered into the gas and air mixing chamber 20. With a small, slow-speed setting of venturi or throttling opening 22*b*, generally as shown in FIGS. 3 and 4, a carefully measured, relatively small amount of gas is sucked from the end of the gas supply tube 23 by the proportionately effective amount of air sucked through the venturi opening. Accordingly, the amount of liquid gas sucked into the air passing through the gas and air mixing chamber 20 is so efficiently atomized that it can be accurately controlled by a preadjusted size of the venturi opening 22*b*. That is, the self-adjusting nature of the gas and air mixing structure shown and described is such that maximum speed or acceleration rate of the engine is possible with a minimum of gas consumption, as well as with accomplishment of complete atomization of the ignited gas globules.

In use of the improved carburetor for some purposes, reduction of the air speed into the air and gas mixing chamber 20 may be desirable to save gas while attaining maximum power. To this end, and in reference to the modification shown in FIG. 6, which corresponds substantially to FIG. 4, in conjunction with FIG. 2, the speed of the air passing into the mixing chamber 20 through the venturi opening 22*b* in the slide-plate 18 may be controlled by varying the effective flow area of the opening 22*b*. Automatic adjustment of said flow area may be accomplished as by means of the modified form of slide plate 18 shown in FIG. 6, wherein plate 18 is provided with a series of spaced passages or holes 31, 31, extending from at least one inner edge 22*a* of the plate 18, defining the adjustable size of the venturi opening 22*b*, to a longitudinally extending passage 32 connecting with a vacuum tube 33 from a vacuum-operated, accelerator controlled, valve or motor 34 which, through a suitable linkage 37 to the slide control arm or rod 30 (See FIG. 2), adjusts the size of said venturi opening as well as the amount of gas being mixed with air passing through the same.

As an example, in operation of an engine at high speeds the carburetor can be self-operating, by the higher speeds of the air being sucked or drawn through the venturi opening 22*b*, correspondingly to reduce the size of the venturi opening and at the same time control the amount of gas fed through the same. It would be possible, for example, through variations in the number of openings 31 exposed in the effective venturi opening 22*b* to calculate and provide appropriate spacing and sizes of the gas metering openings 28 in the metering tube 24, thereby to attain maximum economy of gas use at the high speeds which heretofore would have resulted in un-burned gas with use of the prior art carburetors.

Normally, in the use of internal combustion engines too much carboration too quickly could cause an engine to stall. In use of the vacuum control described above, and particularly as best shown in FIG. 2 in relation to the automatic accelerator speed-control structure shown in FIGS. 5 and 6, operators, for example, can step on the usual accelerator pedal, and if there is no demand for more air the suction created in the vacuum motor 34 will move the diaphram 34*a* thereof to shift the rigid arm 30 connected to the fuel feed tube 23, thereby to adjust the flow of air and fuel being fed to the carburetor accordingly. If, for example, until there is enough air going through the carburetor the diaphram 34*a* will, with resultant movement of the rod 30, control the throttle. The purpose of the vacuum motor 34, therefore, is to adjust the opening through the carburetor, automatically, in accordance with the air demand of the engine.

For this purpose, as best shown in FIGS. 2 and 6, the automatic accelerator speed-control linkage 38 may include an arm 38*b* pivoted to a fixed bracket 39, with one end extent of 38*a* of the arm 38*b* pivoted to a vacuum operated shaft 40 of the vacuum motor 34, and an opposite end extent connected to the rod 30, for reciprocating the fuel supply tube 23. Also, at a point at or near the lower end of arm extent 38*a*, a stop portion 42 is suitably provided for engagement with throttle stop 43 on an end of an axially shiftable rod 45 of a known type of accelerator or like device (not shown), which is controlled by an operator. When the throttle stop 43 is retracted from the arm stop 42 with the throttle rod 45, it allows the vacuum device 34 to control the effective throttle opening 28 of the carburetor. A spring 44 or other suitable means provided in the vacuum pump will otherwise tend to close the carburetor throttle opening.

Other modifications of the invention may be resorted to without departing from the spirit thereof or the scope of the appended claims.

What is claimed is:

1. A carburetor, as for a gasoline engine, comprising, a housing having connecting air-intake and gas-mixing chambers; a slide-valve member, adjustably mounted between said chambers, and having a venturi-aperture means of variable flow area therethrough, for passage of air from said air-intake chamber to said gas-mixing chamber with correspondingly varying venturi effect on said air; means for adjusting said slide-valve member to vary the flow area of said venturi-aperture means; and a gas metering device presented within said gas-mixing chamber, for supplying gas to said gas-mixing chamber for convergence with air passed through said venturi-aperture means, said slide-valve member including vacuum aperture means communicating with said venturi-aperture means; and accelerator speed-control means operable by variations in vacuum effect in said vacuum aperture means to adjust the size of the venturi opening, with resultant proportional automatic adjustment of the amount of gas being mixed with air passing through the effective venturi opening, said vacuum aperture means in the slide-valve member including a series of spaced passages communicating with said effective venturi aperture opening.

2. A carburetor as in claim 1, including a vacuum operated, accelerator control device operatively connected to said slide-valve member to move the same and thereby adjust the size of the venturi opening, with resultant proportional automatic adjustment of the amount of gas being mixed with air passing through the effective venturi opening.

3. A carburetor as in claim 1, said gas supply tube having a gas outlet orifice in a free end thereof presented within said gas mixing chamber; and a tapered stem being affixed to said housing to extend into said gas supply tube through said outlet orifice to vary the effective gas flow area thereof in proportion to relative movement of the supply tube, vacuum aperture means being provided in said slide-valve member for communicating with said venturi-aperture means; and a vacuum operated, accelerator speed control device operatively connected to said slide valve member to move the same and thereby adjust the size of the venturi opening, with resultant proportional automatic adjustment of the amount of gas being mixed with air passing through the effective venturi opening.

4. A carburetor as for a gasoline engine, comprising: a housing having connecting air-intake and gas-mixing chambers, a slide-valve member, adjustably mounted between said chambers, and having a venturi-aperture means of variable flow area therethrough, for passage of air from said air-intake chamber to said gas-mixing chamber with correspondingly varying venturi effect on said air; means for adjusting said slide-valve member to vary the flow area of said venturi aperture means, and a gas metering device presented within said gas-mixing chamber, for supplying gas to said gas-mixing chamber for convergence with said air passed through said venturi aperture means; said gas metering device including relatively movable parts to vary the supply of gas to said chamber, said relatively movable parts of the gas metering device including a relatively fixed tube having therein a plurality of gas metering holes, and a gas supply tube relatively movable with reference to said relatively fixed tube, to open and close one or more said gas metering holes to said gas mixing chamber, said gas supply tube having a gas outlet orifice in a free end thereof presented within said gas mixing chamber; and a tapered stem being affixed to said housing to extend into said gas supply tube through said outlet orifice to vary the effective gas flow area thereof in proportion to relative movement of the supply tube, said slide-valve member including vacuum aperture means communicating with said venturi-aperture means; and accelerator speed-control means operable by variations in vacuum effect in said vacuum aperture means to adjust the size of the venturi opening, with resultant proportional automatic adjustment of the amount of gas being mixed with air passing through the effective venturi opening.

* * * * *